US005515801A

United States Patent [19]

Fortin et al.

[11] Patent Number: 5,515,801

[45] Date of Patent: May 14, 1996

[54] FOLDING TRIMARAN

[75] Inventors: Michel Fortin, Caen; Pascal Rouet, Saint Thibault des Vignes, both of France

[73] Assignee: M.C.F., Caen, France

[21] Appl. No.: 391,409

[22] Filed: Feb. 16, 1995

[30] Foreign Application Priority Data

Feb. 18, 1994 [FR] France ..... 94 01868

[51] Int. Cl.[6] ..... B63B 1/00

[52] U.S. Cl. ..... 114/61; 114/123

[58] Field of Search ..... 1.4/61, 123, 274, 1.4/282, 283, 353, 291

[56] References Cited

U.S. PATENT DOCUMENTS

| | | | |
|---|---|---|---|
| 4,286,533 | 9/1981 | Sanner | 114/61 |
| 4,718,368 | 1/1988 | Ings | 114/61 |
| 4,878,447 | 11/1989 | Thurston | 114/61 |
| 5,235,925 | 8/1993 | Farrier | 114/61 |

*Primary Examiner*—Stephen Avila
*Attorney, Agent, or Firm*—Wolf, Greenfield & Sacks

[57] ABSTRACT

Folding trimaran which is symmetrical in relation to its median longitudinal axis and comprises a central hull, equipped with a mast, and also two lateral floats, which are connected to the central hull by at least one connecting arm. The trimaran can be moved between a first position in which the connecting arms are unfolded approximately horizontally on each side of the central hull, substantially perpendicularly to the longitudinal axis of the latter, and a second position in which the floats are folded along the central hull in such a manner as to reduce the space requirement. The trimaran has at least two connecting arms arranged symmetrically to define a maneuvering pair extending as far as the median horizontal axis. This pair is one on the other or separate at a place and are connected to the mast by one or two sliding carriages which can be moved in translation along the mast in order to enable the trimaran to be moved from the sailing position into the mooring position or vice versa by folding the two floats either at the same time or separately.

9 Claims, 3 Drawing Sheets

FOLDING TRIMARAN

The present invention relates to a folding trimaran which is symmetrical in relation to its median longitudinal axis.

In recent years a considerable development has been observed in yachting and a large number of individuals have already acquired or intend to acquire a sailing boat.

The current yachting fleet, especially in the field of medium-size craft, is made up principally of conventional single-hull boats which are relatively inexpensive and are broadly satisfactory from the point of view of comfort and the possibilities of interior fitting-out.

However, influenced by the great transoceanic races, yachtsmen who are looking for sporting performance tend to turn towards multi-hull craft and, in particular, catamarans which have a better performance than have single-hull craft but which are relatively difficult to steer and are expensive to fit out in the conventional manner, bearing in mind, the presence of the two hulls and the deck cabin.

Trimarans are able to offer yachtsmen all the comfort they may desire; they are cruising yachts comprising a central hull (1) equipped with conventional type, and also two lateral floats (3, 3') connected to the central hull (1) by at least one connecting arm (4) (FIG. 1). The whole thus formed, which is exactly symmetrical in relation to its median longitudinal axis (x-x'), gives the advantage of permitting a traditional arrangement around a central living area. The sporting performance and, in particular, the cruising speed of trimarans are, especially in light winds, better than those of catamarans, compared with which they have the additional advantage of being easier to steer and generally easier to turn.

Despite the above-mentioned natural advantages of trimarans, specialists in yacht construction have hitherto shown little interest in them, especially in medium-size trimarans, the corollary of which is that their cost remains high and consequently their development has been limited as regards potential clientele.

This state of affairs is essentially the result of the width, and therefore the space requirement, of trimarans which to a largo extent increases security costs; in addition, trimarans are for that reason essentially difficult to manoeuvre in ports.

To overcome those disadvantages, specialists in the field of nautical construction have already proposed folding trimarans which can be moved between, on the one hand, a first position or sailing position in which the connecting arms are unfolded approximately horizontally on each side of the central hull, substantially perpendicularly to the longitudinal axis of the latter, and, on the other hand, a second position or mooring position in which the floats are folded along the central hull in such a manner as to reduce the space requirement in port and to bring it down to that of a single-hull boat of the same length.

According to FIG. 1, a horizontal folding system has already been proposed according to which each of the connecting arms 4 is articulated, on the one hand, to the associated float 3 and, on the other hand, about a substantially vertical axis 5, at its end that is contiguous with the central hull 1, in such a manner that it can be folded through 90° according to arrow I along the central hull.

The disadvantage of such a configuration is either that floats 3, 3' that are shorter than the central hull 1 must be selected, or that, once folded, the floats project a long distance beyond the rear portion of the central hull, which entails an increase in the cost of mooring.

According to FIG. 2, another folding system that has already been proposed is a vertical folding system referred to as the "Yan Farrier" system, by means of which each of the connecting arms 4 is secured to two fixed points $a_1$, $a_2$ of the central hull 1 by means of a respective profile member $\mathbf{6}_1$, $\mathbf{6}_2$ in such a manner as to enable the connecting arm 4 to be folded into a vertical position according to arrow II.

That system, which enables each of the floats to be folded separately, has been found to be very suitable for small boats (less than 9 meters in length) which can be readily winched up onto a trailer and rapidly dismasted, but it loses that advantage in the case of medium-size yachts, taking into account the fact that a reduced width is necessary in order to avoid having to dismount the arms and the floats for transport.

The aim of the present invention is to use a system that differs from the prior art by proposing a trimaran equipped with folding members which are both simple and efficient and, in addition, can be adapted to any trimaran regardless of its dimensions, at the same time offering improved habitability and performance.

To that end, the invention proposes a trimaran of the above-mentioned type, characterised in that at least two connecting arms arranged symmetrically in such a manner as to define a manoeuvring pair extend as far as the median horizontal axis, are articulated one on the other or separately at that place and are connected to the mast by one or two sliding carriages which can be moved in translation along the mast in order to enable the trimaran to be moved from the sailing position into the mooring position or vice versa by folding the two floats either at the same time or separately.

This movement can of course be effected mechanically or manually using windlasses or winches without departing from the scope of the invention; it is advantageously possible to use one or two conventional carriages of the swinging boom type.

It should be noted that in the common case, shown in particular in FIG. 1 in which the trimaran is equipped with two pairs of securing arms, one mounted on the front and one on the rear of the central hull, the rear connecting arms integral with the floats, and therefore with the front arms guided by the mast during unfolding and folding manoeuvres, merely move freely; it is therefore not necessary for them to extend as far as the median longitudinal axis and it may even prove advantageous to interrupt them and simply bolt them on each side of the central hull, especially to the lateral housings generally arranged in that area which then bear the compressive forces. Space is therefore saved and weight is reduced in the area of the central hull and, in addition, there is more room to walk about.

It has been found that it is absolutely necessary during unfolding/folding manoeuvres to prevent the connecting arms constituting the manoeuvring pair and also the floats from oscillating freely on each side of the mast, and therefore to provide supplementary supporting members.

To that end, and according to an essential feature of the invention, each of the connecting arms forming the manoeuvring pair cooperates with a respective supporting profile member which is articulated at its ends, on the one hand, at a fixed anchoring point of the central hull and, on the other hand, at an anchoring point which can be rotated about that fixed point and which is secured to the associated connecting arm.

These arms constitute a simple adjustment system for conventional trimarans with an anti-drift and steering fin in the central hull.

Of course, the length of the supporting profile members and also the position of their anchoring point on the associated connecting arms must be calculated in such a manner as to suit both the sailing position and the mooring position; it should be noted that, for any one boat, there is only one correct size, depending on its length and the anchoring points on the hull.

In the case of a trimaran equipped with two pairs of connecting arms, it is sufficient to provided a single supporting profile member for each connecting arm; on the other hand, in the case of a trimaran equipped with a single pair of connecting arms, it is necessary to provide two supporting profile members for each connecting arm, one articulated at its front portion and the other articulated at its rear portion, in such a manner as to block the torsional movements imposed by the float.

Furthermore, traditional trimarans are conventionally equipped with a rudder and either a drop keel or a fixed keel mounted in the central hull, and floats securely bolted to the connecting arms, in which case the above-mentioned configuration has been found in practice to be broadly satisfactory.

However, trimarans have recently appeared in competition which have a better performance and in which each of the floats is equipped with a drop keel and a rudder in order to enable the central hull to be relieved of the cumbersome drop keel well or the low-performance fixed keel. The current trend is not to mount the drop keels vertically but with an inclination of from 20° to 30° in order to give the boat the advantage of a "foil" effect.

If it is desired to adapt such a configuration to a folding trimaran according to the invention it is necessary to be able to bring each of the drop keels back to the vertical position when the floats are folded along the central hull.

To that end, and according to another feature of the invention, each of the floats is mounted to be pivotable with respect to the associated connecting arm(s) and cooperates with means enabling its inclination to be varied with respect to the vertical.

The outer end of each arm may advantageously be mounted on the float by means of one or two pivoting lugs articulated with the arm and rigidly fixed to the superexternal periphery of the float; there will always be two pivoting lugs for each arm.

According to another feature of the invention, the means enabling the inclination of the floats to be varied with respect to the vertical are formed by pivoting profile members cooperating respectively with each connecting arm constituting the manoeuvring pair, each of the pivoting profile members being articulated at its ends, on the one hand, at an anchoring point on the associated supporting profile member and, on the other hand, at an anchoring point located on the internal periphery of the associated float.

It should be noted that the longer are the pivoting profile members, the greater is the difference between the angular positions of the floats in the sailing position, on the one hand, and in the meeting position, on the other.

The device according to the invention is thus excellently suited to trimarans having a vertical drop keel and an inclined drop keel ("foil" effect) since the designer can select the angle formed by the arm with the float in the mooring position, in which it is folded along the central hull.

According to another feature of the invention, the supporting profile members and/or the pivoting profile members are equipped with adjusting members of the turnbuckle type enabling their length to be varied.

That configuration enables the user himself to carry out a fine adjustment whenever necessary.

The feature of the folding trimaran forming the subject of the invention will be described in more detail with reference to the attached drawings, in which.

Figure 1:
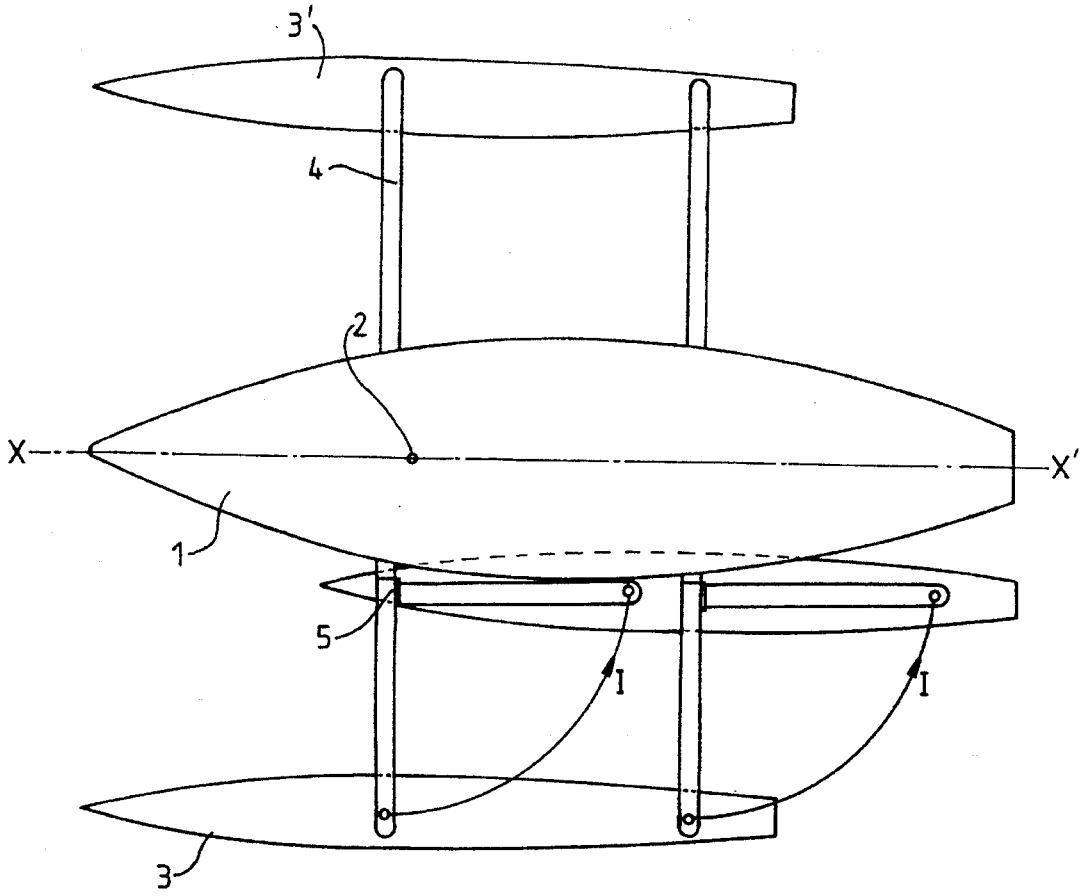
FIG. 1 is a diagrammatic plan view of a trimaran equipped with a folding device according to a first variant of the prior art.
Figure 2:
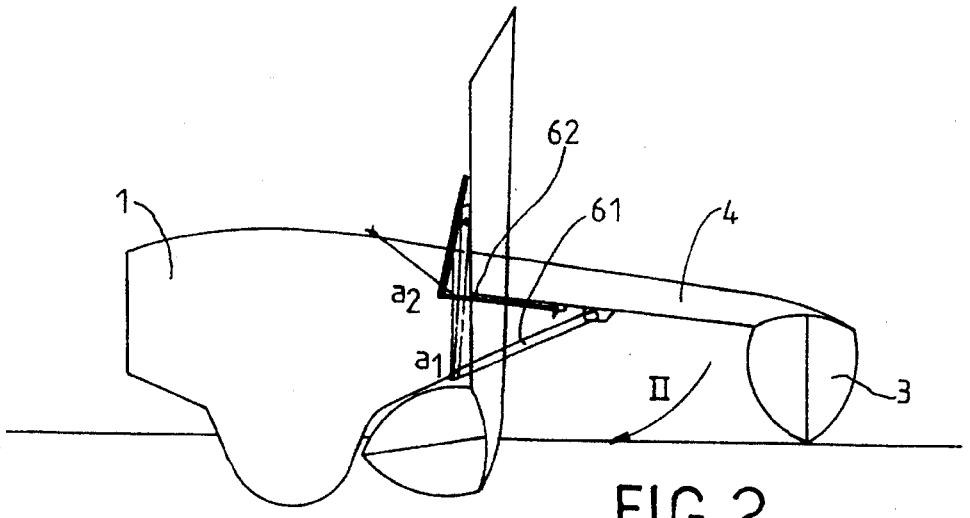
FIG. 2 is a diagrammatic front view of a trimaran equipped with a second variant of the folding device according to the prior art.
Figure 3:
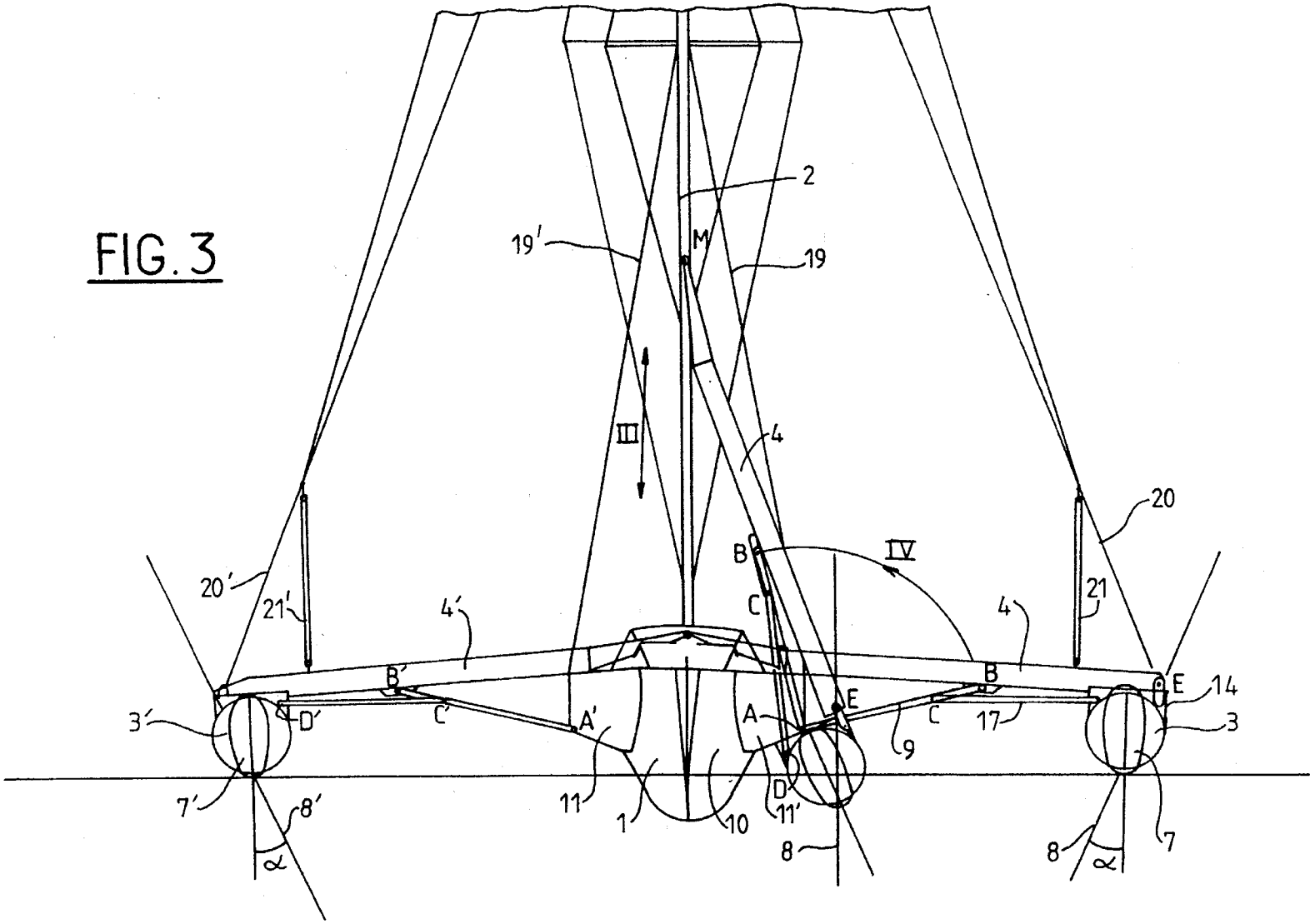
FIG. 3 is a diagrammatic front view of a trimaran according to the invention.

According to FIG. 3, the trimaran is formed by a central hull 1 equipped with a mast 2 and also by two lateral floats 3, 3' connected to the central hull 1 by connecting arms 4, 4' which are unfolded substantially horizontally when the yacht is in the normal sailing position. The arms 4, 4' cooperate in pairs to form a front pair or manoeuvring pair, which is shown in FIG. 3 and the configuration of which will be described in more detail hereinafter, and also a rear pair (not shown).

At its inner part, the central hull 1 delimits the traditional living area 10 and is bounded on each side by two lateral housings 11, 11' used for movement on deck and for the storage of equipment, The floats are for their part equipped with a rudder 7, 7' and also a drop keel 8, 8' which is inclined with respect to the vertical by an angle $\alpha$ of from 20° to 30° so as to give the boat the advantage of a "foil" effect.

According to FIG. 3, the connecting arms 4, 4' which define the manoeuvring pair extend as far as the median longitudinal axis of the boat, which is shown diagrammatically by the point M, and are articulated one on the other at that place.

The point of articulation M of the connecting arms 4, 4' is, in addition, connected to the mast 2 by means of a sliding carriage of the swinging boom type (not shown) which is capable of moving in vertical translation along the mast as shown diagrammatically by the double arrow III.

The trimaran can thus be moved between the normal sailing position in which it is represented in its entirety in FIG. 3 and a mooring position represented only in the right half of the Figure in which the point of articulation M of the connecting arms 4, 4' is displaced to the upper portion of the mast 2 and the floats 3, 3' are folded along the central hull 1 in such a manner as to reduce the space requirement of the trimaran.

According to FIG. 3, each connecting arm is guided and supported during unfolding/folding manoeuvres by a supporting profile member 9 which is articulated at one of its ends as a point A, A' which is integral with the central hull 1 and at its opposite end at a point B, B' which is integral with the associated arm 4, 4', and is therefore rotatable according to the arrow IV about the point A, A' during unfolding/folding manoeuvres.

Figure 4:
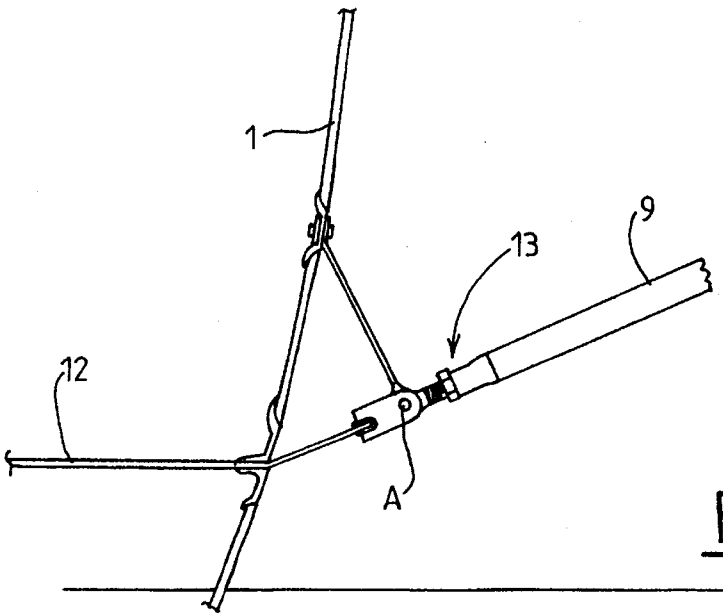

According to FIG. 4, the articulation of the first end of the supporting profile members 9 is effected by means of a flat member 12 extending through the hull 1, the flat member being merely one means among others for transmitting the traction forces from point A to point A' of the trimaran, as well as by means of a system of the turnbuckle type 13 permitting fine adjustment of the length of the profile member.

Figure 5:
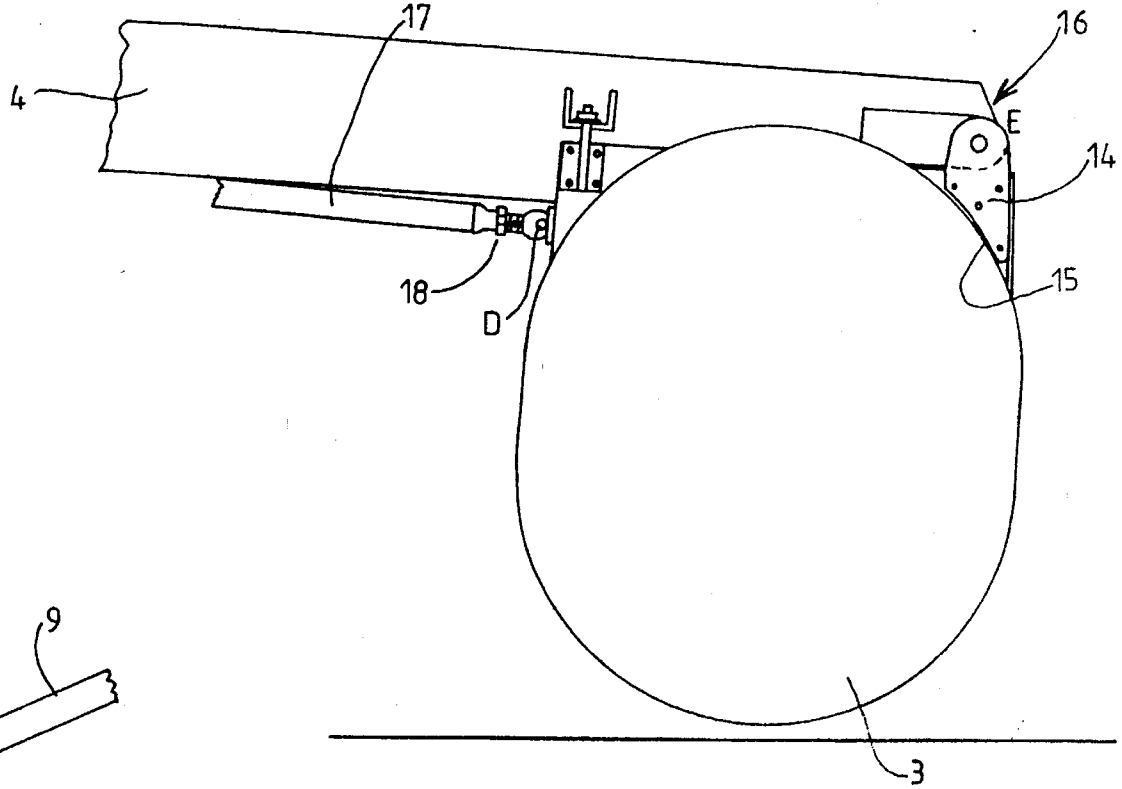
FIGS. 4 and 5 are, respectively, detailed diagrams of the area of the anchoring point of a supporting profile member on the central hull and of a pivoting profile member on a float.

In addition, and according to FIGS. 3 and 5, each of the floats 3, 3' is mounted to be pivotable with respect to the associated connecting arms 4, 4' by means of a pivoting lug 14, one end 15 of which is rigidly fixed to the periphery of the float 3, 3' while the opposite end is articulated at a point E at the outer end 16 of the connecting arm 4, 4'.

Each pivoting lug 14 also cooperates with a pivoting profile member 17, one end of which is articulated at a point C, C' of the associated supporting profile member while the opposite end is articulated at a fixed point D, D' which is integral with the internal periphery of the float 3, 3'.

It is obvious that, by selecting carefully the length of each of the pivoting profile members 17, as well as the position of the points of articulation C, C' on the associated supporting profile members, it is possible to displace in an angular manner the drop keels 8, 8' during unfolding/folding manoeuvres in such a manner as to bring them back into the vertical position when in the mooring position, as shown on the right-hand side of FIG. 3.

According to FIG. 5, it is also possible to effect fine adjustment of the length of the pivoting profile members 17 by means of adjusting members 18 of the turnbuckle type.

The mask has two lower shrouds 19 and 19' which ensure a constant geometry of the hull 1 and the mast 2 when the backstays 20 and 20' slacken during folding and have not yet been tightened by the blocks and tackle 21, 21'.

We claim:

1. Folding trimaran which is symmetrical in relation to its median longitudinal axis and comprises a central hull (1), equipped with a mast (2), and also two lateral floats (3, 3'), which are connected to the central hull by at least one respective connecting arm (4, 4'), which trimaran can be moved between, on the one hand, a first position or sailing position in which the connecting arms are unfolded approximately horizontally on each side of the central hull (1), substantially perpendicularly to the longitudinal axis (x-x') of the latter, and, on the other hand, a second position or meeting position in which the floats (3, 3') are folded along the central hull (1) in such a manner as to reduce the space requirement, which trimaran is characterised in that at least two connecting arms (4, 4') arranged symmetrically in such a manner as to define a manoeuvring pair extend as far as the median horizontal axis (x, x'), are articulated one on the other or separately at that place (M) and are connected to the mast (2) by one or two sliding carriages which can be moved in translation along the mast in order to enable the trimaran to be moved from the sailing position into the mooring position or vice versa by folding the two floats either at the same time or separately.

2. Folding trimaran according to claim 1, characterised in that each of the connecting arms (4, 4') forming the manoeuvring pair cooperates with a respective supporting profile member (9) which is articulated at its ends, on the one hand, at a fixed anchoring point (A) of the central hull (1) and, on the other hand, at an anchoring point (B) which can be rotated about that fixed point (A) and which is secured to the associated connecting arm (4).

3. Folding trimaran according to claim 2, characterised in that each of the floats (3, 3') is mounted to be pivotable with respect to the associated connecting arm(s) (4, 4') and cooperates with means enabling its inclination ($\alpha$) to be varied with respect to the vertical.

4. Folding trimaran according to claim 3, characterized in that each float (3, 3') is mounted on each of the associated arms (4, 4') by means of a pivoting lug (14) articulated on the arm at one of its ends (16) and rigidly fixed to the periphery of the float (3, 3') at its opposite end (15).

5. Folding trimaran according to either claim 3 or claim 4, characterised in that the means enabling the inclination ($\alpha$) of the floats (3, 3') to be varied with respect to the vertical are formed by pivoting profile members (17) cooperating respectively with each connecting arm (4, 4') constituting the manoeuvring pair, each of the pivoting profile members (17) being articulated at its ends, on the one hand, at an anchoring point of the associated supporting profile member (9) and, on the other hand, at an anchoring point located on the periphery of the associated float (3).

6. Folding trimaran according to claim 2, characterised in that the supporting profile members (9) and/or the pivoting profile members (17) are equipped with adjusting members of the turnbuckle type (13, 18) enabling their length to be varied.

7. Folding trimaran according to claim 3, characterised in that the supporting profile members (9) and/or the pivoting profile members (17) are equipped with adjusting members of the turnbuckle type (13, 18) enabling their length to be varied.

8. Folding trimaran according to claim 4, characterised in that the supporting profile members (9) and/or the pivoting profile members (17) are equipped with adjusting members of the turnbuckle type (13, 18) enabling their length to be varied.

9. Folding trimaran according to claim 5, characterised in that the supporting profile members (9) and/or the pivoting profile members (17) are equipped with adjusting members of the turnbuckle type (13, 18) enabling their length to be varied.

* * * * *